US006641363B2

(12) United States Patent
Barrett et al.

(10) Patent No.: US 6,641,363 B2
(45) Date of Patent: Nov. 4, 2003

(54) GAS TURBINE STRUCTURE

(75) Inventors: David W Barrett, Derby (GB); Philip D Robinson, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/206,771

(22) Filed: Jul. 29, 2002

(65) Prior Publication Data

US 2003/0035722 A1 Feb. 20, 2003

(30) Foreign Application Priority Data

Aug. 18, 2001 (GB) ..... 0120217

(51) Int. Cl.[7] ..... F01D 11/24

(52) U.S. Cl. ..... 415/116; 415/108; 415/175; 415/178

(58) Field of Search ..... 415/115, 116, 415/108, 173.2, 173.3, 175, 176, 177, 178

(56) References Cited

U.S. PATENT DOCUMENTS 3,425,665 A * 2/1969 Lingwood ..... 415/134
3,990,807 A * 11/1976 Sifford ..... 415/136
4,157,232 A * 6/1979 Bobo et al. ..... 415/116
5,407,320 A * 4/1995 Hutchinson ..... 415/116
5,584,651 A * 12/1996 Pietraszkiewicz et al. .. 415/115
6,179,557 B1 * 1/2001 Dodd et al. ..... 415/115
6,227,800 B1 * 5/2001 Spring et al. ..... 415/116
6,302,642 B1 * 10/2001 Nagler et al. ..... 415/116
6,340,285 B1 * 1/2002 Gonyou et al. ..... 415/116
6,508,623 B1 * 1/2003 Shiozaki et al. ..... 415/173.1

FOREIGN PATENT DOCUMENTS

| | | |
|---|---|---|
| EP | 1 052 372 A2 | 11/2000 |
| GB | 1 491 112 A | 11/1977 |
| GB | 2 104 965 A | 3/1983 |
| GB | 2 117 451 A | 10/1983 |
| GB | 2 125 111 A | 2/1984 |

* cited by examiner

*Primary Examiner*—Christopher Verdier
(74) *Attorney, Agent, or Firm*—W. Warren Taltavull; Manelli Denison & Selter PLLC

(57) ABSTRACT

A stage of turbine blades (40) in a gas turbine engine (10) is surrounded by an array of shroud segments (42). The upstream ends of the segments (42) have plenum chambers (54) into which cooling air is fed from a compressor (12) via one hole (66) of a pair of holes, the other being numbered (68). Air from the plenum chambers (54) passes out to film cool the interior surface of each respective segment (42). Air from holes (68) passes out to convection cool the exterior surface of each segment (42), which effect is enhanced by the provision of ribs (80) and fences (82).

8 Claims, 3 Drawing Sheets

GAS TURBINE STRUCTURE

The present invention relates to a gas turbine engine, the turbine system of which is provided with a flow of cooling air over the static (non rotating) structure surrounding a stage of turbine blades, when they rotate during operation of the gas turbine engine.

It is known to form that part of the gas annulus which surrounds a stage of turbine blades from a plurality of arcuate segments. It is further known during operation of the associated engine, to direct a flow of cooling air bled from a compressor of the engine, over both inner and outer surfaces of the segments. The known art provides a single cooling air flow which is not divided so as to flow over the segments inner and outer surfaces, until it reaches some part thereof. A consequence arising from the arrangement is that insufficient cooling air flow control is available to enable direction of appropriate quantities of air to the respective surfaces. Additionally the quantities differ, one surface to the other, so that overall there is inefficient cooling.

The present invention seeks to provide a gas turbine engine including improved cooling air flow distribution.

According to the present invention, a gas turbine engine includes a stage of turbine blades surrounded by a plurality of arcuate segments, the inner surfaces of which define a part of the turbine gas annulus, each said segment including a plenum chamber at its upstream end connected in cooling air flow series with a cooling air supply via a cooling air distributing member, which member has cooling air inlets from said supply, and cooling air outlets, each cooing air inlet being in flow series with a respective pair of cooling air outlets, and wherein during operation of the associated engine, one outlet of each pair of outlets passes cooling air flow to a respective plenum chamber, and the other outlet of each said pair of outlets passes cooling air flow to the radially outer surface thereof.

The invention will now be described by way of example and with reference to the accompanying drawings, in which.

Figures 1, 2:
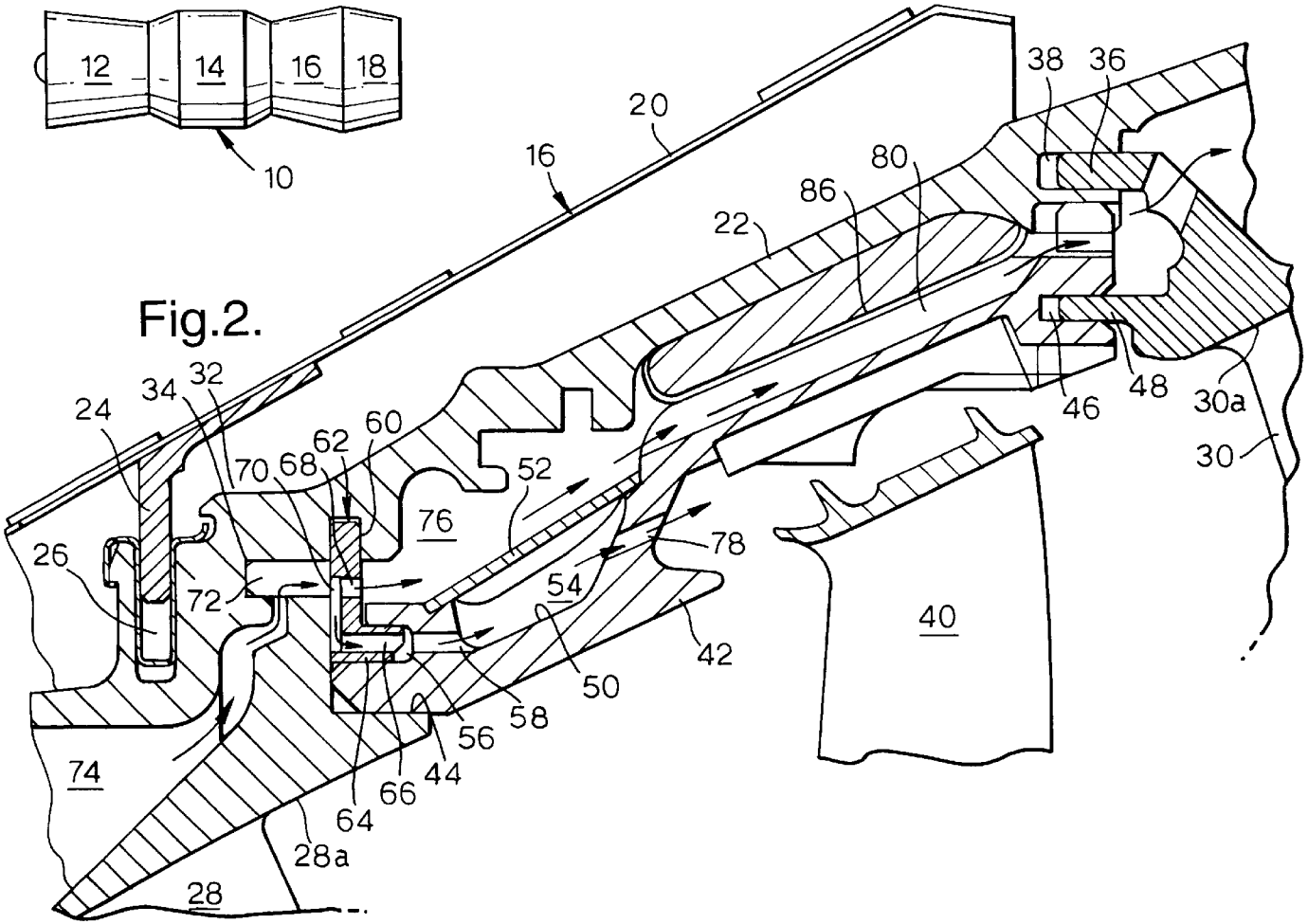
FIG. 1 is a diagrammatic sketch of gas turbine engine in accordance with the present invention.
FIG. 2 is an axial cross sectional part view through the turbine system of the engine of FIG. 1.

Referring to FIG. 1 a gas turbine 10 has a compressor 12, a combustion system 14, a turbine system 16, and an exhaust nozzle 18.

Referring to FIG. 2 the turbine system 16 includes an outer skin 20 which surrounds a casing 22 in coaxial relationship, and locates it against movement axially of engine 10 by means of a flanged member 24 fitting in an annular groove 26 in casing 22.

Casing 22 supports two axially spaced stages of guide vanes 28 and 30, by means of a hook on each guide vane in stage 28 locating in a birdmouth annular slot 34 in casino 22, and a hook 36 on each guide vane 30 locating in another birdmouth annular slot 38 in casing 22, downstream of birdmouth annular slot 34. The term downstream relates to the direction of gas flow through engine 10. A stage of rotatable turbine blades 40 is positioned between guide vane stages 28 and 30.

The gap between guide vane stages 28 and 30 is bridged by a circular array of segments 42, which segments with the inner surfaces of guide vane platforms 28*a* and 30*a*, thus complete that part of the outer wall of the gas annulus as viewed in each guide vane platform 28*a*, and their downstream ends each have a birdmouth annular slot 46, into which further hook 48 on each guide vane platform 30*a* is fitted.

Each segment 42 has one or more depressions 50 formed in its radially outer surface, at a position near its upstream end. Each depression 50 is covered by a plate 52, thereby forming a plenum chamber 54. Alternatively the plenum chamber 54 could be cast in. The upstream end of each segment 42 includes a birdmouth slot 56, and the wall thickness between slot 56 and plenum chamber 54 is drilled to provide passageways 58 though which, during operation of engine 10, cooling air may flow into plenum chamber 54, for reasons to be explained later in this specification.

The end extremities of birdmouth slots 56 are spaced from the opposing walls of guide vane platforms 28*a*, and a flanged portion 60 of an annular ring 62 is fitted therebetween. A spigot 64 on ring 62 fits into the birdmouth 56 of each segment 42. Spigot 64 is drilled though its axial length in several angularly spaced places, to provide cooling air passageways 66 in alignment with passageways 58. More angularly spaced cooling air passageways 68 are drilled through flange 60, so as to break therethrough at places externally of the segments 42, and in radial alignment with cooling air passageways 66. Respective radial slots 70 in flange 60 join each radially aligned pair of passageways 66 and 68.

Radial slots 70 are angularly aligned with slots 72 cut through the hooks 32 of each guide vane platform 28*a*. A cooling air flow path indicated by arrows is thus established, between a space volume 74 to which air from compressor 12 (FIG. 1) is delivered, a space 76 partly defined by the radially outer surfaces of segments 42, and the interior of plenum chamber 54. The space 76 and each plenum chamber 54 thus receive their cooling air flows via respective dedicated passageways 68 and 66, so as to ensure that only air flow rates appropriate to the cooling needs of the respective segment surfaces are provided.

During operation of gas turbine engine 10, cooling air which has entered plenum chambers 54, exits therefrom via passageways 78, to spread over the radially inner surfaces of respective segments 42 and any structure fixed thereto, and so achieve film cooling of the segments 42 in the vicinity of the stage of turbine blades 40. The cooling air is then carried to atmosphere by the gas stream. Cooling air which has passed through outlets 68 in flange 60 flows over the exterior surfaces of plates 52, then over the exterior surfaces of the downstream portions of segments 42, and eventually to atmosphere.

Figure 3:
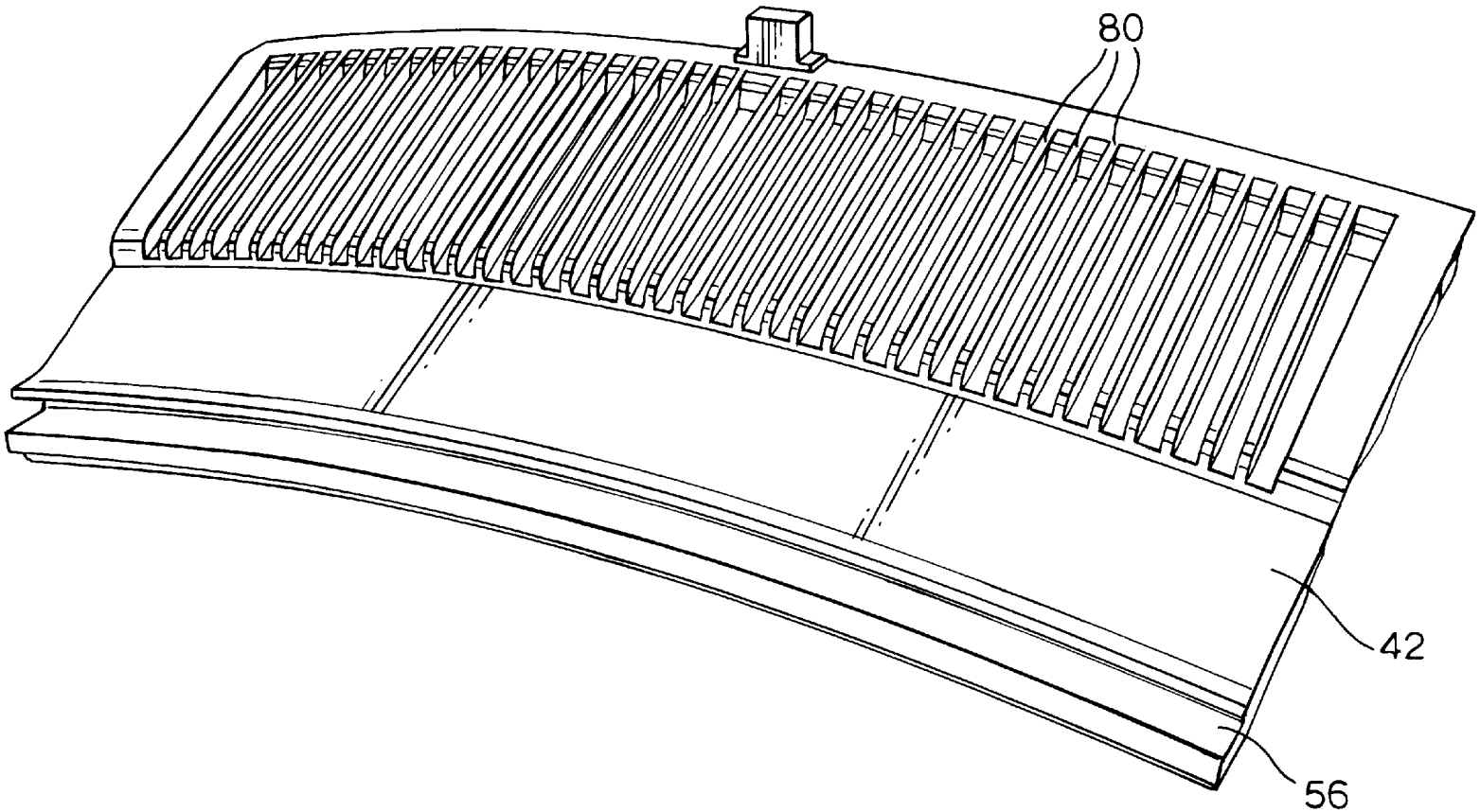
FIG. 3 is a pictorial view of a segment in accordance with one aspect of the present invention.

Whilst as described so far, film cooling of the exteriors of segments 42 is achieved, convection cooling is the preferred mode. Thus ribs 80 are provided on the exterior surfaces of segments 42, and heat conducted thereto from the segments, is convected away by the cooling air flowing between them. Ribs 80 are best seen in FIG. 3.

Figure 4:
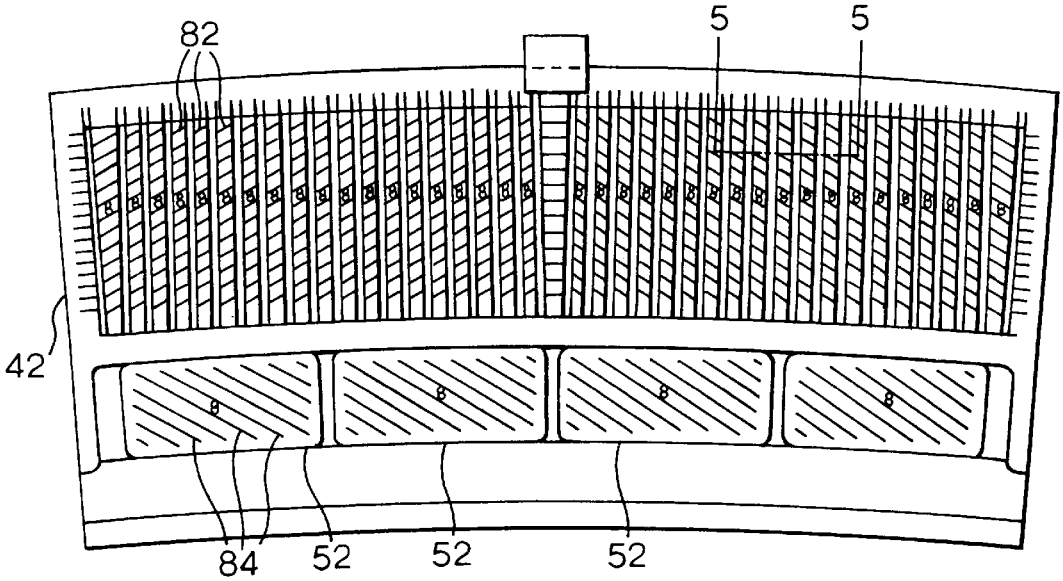
FIG. 4 is a plan view of the segment shown in FIG. 3 with part thereof removed.

Referring now to FIG. 4 in this embodiment of the present invention, turbulators 82 in the form of fences are positioned in between each adjacent pair of ribs 80, so as to increase both the time spent by the air flow between the ribs, and the scrubbing action of the cooling air on the ribs. The presence of the fences and their effect on the flow results in more efficient cooling of the segments.

In FIG. 4 the plates 52 have been omitted. In this arrangement, the plenum chamber 54 radially inner surfaces have fences 84 thereon, which are non parallel with the air flow and consequently generate turbulence thereby providing enhanced cooling of each segment 42.

Figure 5:
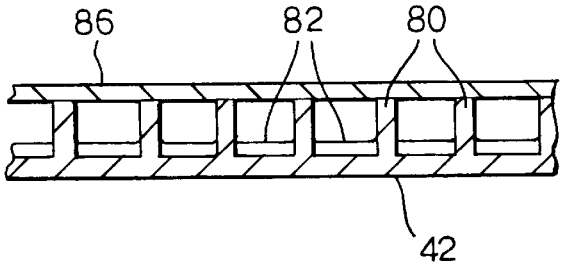
FIG. 5 is a cross sectional part view on line 5—5 in FIG. 4.

Referring to FIG. 5 respective heat shield plates 86, also seen in FIG. 2, cover the ribs 80 on each segment 42, and turbulator fences 82 span the gaps therebetween.

We claim:

1. A gas turbine engine including a stage of turbine blades and a plurality of arcuate segments, said arcuate segments surrounding said stage of turbine blades, the inner surfaces of said arcuate segments defining a part of a turbine gas annulus of said engine, wherein each said segment includes a plenum chamber at its upstream end connected in cooling air flow series with a cooling air supply via a cooling air distribution member, which member has cooling air inlets from said supply, and cooling air outlets, each cooling air inlet being in flow series with a respective pair of cooling air outlets, and wherein during operation of said engine, one outlet of each said pair of outlets passes cooling air to the radially inner surface of a respective segment via an associated plenum chamber, and the other outlet of said pair passes cooling air to the radially outer surface of the respective segment.

2. A gas turbine engine as claimed in claim 1 wherein ribs are provided on the outer surface of each segment, whereby to achieve convection cooling thereof.

3. A gas turbine engine as claimed in claim 2 wherein fences are provided between adjacent ribs, so as to generate turbulence in cooling air flowing thereover.

4. A gas turbine engine as claimed in claim 2 wherein said ribs on each segment are covered by plates.

5. A gas turbine engine as claimed in claim 1 wherein each of said plenum chambers is defined in part by a respective segment and in part by a plate which also forms part of the radially outer surface of said respective segment.

6. A gas turbine engine as claimed in claim 5 wherein said outer surface of said plate has fences thereon, whereby to generate turbulence in cooling air flowing thereover.

7. A gas turbine engine as claimed in claim 1 wherein each said plenum chamber comprises a hollow formed in an integral portion of a respective segment, and an exterior surface thereof forms part of the radially outer surface of said segment.

8. A gas turbine engine as claimed in claim 7 wherein at least part of the interior surface of each said plenum chamber has fences formed thereon, whereby to generate turbulence in cooling air flowing thereover.

* * * * *